US008794341B2

(12) United States Patent
Howard, Sr.

(10) Patent No.: US 8,794,341 B2
(45) Date of Patent: Aug. 5, 2014

(54) RAIN MAKER WILDFIRE PROTECTION AND CONTAINMENT SYSTEM

(76) Inventor: John Wayne Howard, Sr., Bay Point, CA (US)

( * ) Notice: Subject to any disclaimer, the term of this patent is extended or adjusted under 35 U.S.C. 154(b) by 0 days.

(21) Appl. No.: 13/068,268

(22) Filed: May 6, 2011

(65) Prior Publication Data

US 2012/0279731 A1 Nov. 8, 2012

(51) Int. Cl.

| | |
|---|---|
| ***A62C 31/22*** | (2006.01) |
| ***A62C 2/00*** | (2006.01) |
| ***A62C 3/00*** | (2006.01) |
| ***A62C 8/00*** | (2006.01) |
| ***A62C 25/00*** | (2006.01) |
| ***A62C 27/00*** | (2006.01) |
| ***A62C 29/00*** | (2006.01) |
| ***B05B 1/14*** | (2006.01) |
| ***B05B 15/06*** | (2006.01) |
| ***B05B 3/00*** | (2006.01) |
| ***B05B 15/10*** | (2006.01) |
| ***A01G 25/06*** | (2006.01) |

(52) U.S. Cl.

USPC ..... 169/70; 169/52; 169/48; 169/46; 239/550; 239/200; 239/207

(58) Field of Classification Search

CPC ..... A62C 2/08; A62C 99/0072; A62C 25/00; A62C 3/02

USPC ..... 169/52, 66–68, 70, 17, 24, 13, 16, 169/48–50; 239/550, 556, 558, 560, 561, 239/730, 200, 207, 210, 289

See application file for complete search history.

(56) References Cited

U.S. PATENT DOCUMENTS

| | | | | |
|---|---|---|---|---|
| 3,727,841 | A * | 4/1973 | Hengesbach | 239/145 |
| 3,779,461 | A * | 12/1973 | Paul | 239/172 |
| 3,931,931 | A * | 1/1976 | Otis | 239/754 |
| 4,181,179 | A * | 1/1980 | Batte | 169/47 |
| 4,836,291 | A * | 6/1989 | Owens et al. | 169/46 |
| 5,564,448 | A * | 10/1996 | Lincoln | 134/166 R |
| 5,632,341 | A * | 5/1997 | Allen | 169/52 |
| 6,065,693 | A * | 5/2000 | Lukas | 239/548 |
| 6,085,586 | A * | 7/2000 | Arvidson et al. | 73/201 |
| 6,719,065 | B2 * | 4/2004 | Baughman | 169/52 |
| 7,028,783 | B2 * | 4/2006 | Celorio-Villasenor | 169/46 |
| 7,066,414 | B1 * | 6/2006 | McGee et al. | 239/728 |
| 7,225,999 | B2 * | 6/2007 | Foianini et al. | 239/171 |
| 7,299,883 | B2 * | 11/2007 | Wielgat | 169/48 |
| 7,832,492 | B1 * | 11/2010 | Eldridge | 169/45 |
| 2010/0071917 | A1 * | 3/2010 | Lalouz | 169/60 |
| 2010/0175899 | A1 * | 7/2010 | Burkart | 169/52 |

* cited by examiner

*Primary Examiner* — Len Tran
*Assistant Examiner* — Alexander M Valvis
(74) *Attorney, Agent, or Firm* — Winston & Strawn LLP

(57) ABSTRACT

An apparatus, system and method for fire suppression and containment is provided in accordance with one embodiment of the invention. A conduit with a plurality of nozzle connections, in various configurations to create specific fire suppressant discharge patterns. Each conduit can be operated individually or connected to another conduit by a predetermined length of hose forming a contiguous system, traversing large areas of land. The invention and components form a multipurpose fire suppression apparatus. The system can be operated remotely or manually. An alternative embodiment can be installed in residential, commercial and industrial applications. Each system can be custom designed based upon environmental engineering requirements and system application—with regard to conduit diameters, material composition, shape, length and nozzle design without leaving the core design. The system components can also incorporate sensors, monitoring devices, robotics (i.e. RM all terrain vehicle) satellite imaging and wireless technology.

17 Claims, 8 Drawing Sheets

Rain Maker 1

Rain Maker 1

Rain Maker 1A

21 Rain Maker all terrain utility vehicle

28,000 GPM Mobile liquid fire suppressant pump 16,000 GPM Mobile liquid fire suppressant pump 6,900 Gallon 21,000 Gallon mobile liquid fire suppressant storage tanks System Flowchart Diagram of 21 all terrain utility vehicles surrounding a wildfire.

Automatic Fire nozzle

RAIN MAKER WILDFIRE PROTECTION AND CONTAINMENT SYSTEM

Cross-Reference to related provisional patent application filed Sep. 5, 2009, Ser. No. 61/275,920 the priority date, which I claim.

Not federally sponsored.

FIELD OF THE INVENTION

The invention relates to a self contained mobile, high tech, rapidly deployable Wildfire Protection and Containment System.

BACKGROUND OF THE INVENTION

The system is used as an intelligent first responder wild fire protection and containment tool in the first aspect. The new invention cost effectively controls the spread of wildfire, resulting in saving lives, homes and other commercial building structures in high risk urban wild land interface fires. The system is designed to protect entire subdivisions, cities, towns, villages and the environment from an approaching wildfire by remote operation. The robust system creates an effective contiguous suppression blanket on fuel sources and multi story building structures using new method called layering. The use of this system and methods described in this application will save governments and insurance companies billions in cost to fight wildfire and resulting damages.

The invention is designed to protect entire neighborhoods, large tracts of land, by traversing several linear miles of land if needed, over any type of terrain. The Rain Maker system is self contained, operates by remote control transmitter after set up, and operates independent of fire trucks. After system initial rapid setup and system check by first responders, fire fighters activate the system by remote transmitter (a wireless device), as they retreat to a safe zone removing all personnel and fire trucks from the danger zone. The Rain Maker will then blanket buildings and fuel sources in a 360 degree contiguous pattern projecting fire suppressant more than four stories skyward, into tree tops and all over buildings creating a rain like blanketing effect, thus treating all possible ignition points with suppressant slurries, gel mixes or water, starving the fire of fuel sources. Thus the name The Rain Maker was born. Wildfires are becoming increasingly more devastating every year as more and more subdivisions are being built in high risk Wild land Urban Interface areas. Traditional methods of fighting wildfire have had little impact on saving homes and other building structures. In California where I live, wildfires are an annual occurrence. West coast wildfire events always have several factors involved, the lack of rain, extreme heat, wind, hills, slopes, very tall oily trees, scrub brush, dry arid conditions, and an abundance of extremely dry fuel sources including homes with wooden roofs built next to wild forest land. When the combination of the above mentioned conditions comes together with an ignition source like a lightening strike, down power line or human error it usually produces a large out of control wildfire. Once the fire reaches the neighborhood and starts burning homes the heat and flames are intensified, add high wind and you have a 3-5000 degree F. inferno. It becomes virtually impossible to stop the domino effect of trees, homes and subsequent flying embers igniting everything around them. It is common at this stage of wild land urban interface fire for incident command to pull all fire fighting personnel out of harms way. As risk of injury and death to fire fighters are at their highest. Also it is at this stage in the fire fight that multiple fires are igniting throughout the area due to wind driven debris.

The key to preventing the destruction of homes and commercial buildings subsequently entire towns, is a device and system that overcomes the conditions mentioned above. A 23 year veteran battalion Chief who has battled wildfire first hand, and whom tested my prototype invention believes that it will create a paradigm shift in the wildfire theater on many fronts. See Chief Cormier's letter included with this application file. I believe I have incorporated 21$^{st}$ century technology along with optimum capability that would give a first responder an intelligent fire fighting tool that would enable them to obtain faster containment using the safest method or best practice. Currently fire fighters worldwide are still using conventional fire fighting methods, single hose and nozzle per fireman and a few monitor apparatus and air tankers in their assault. However some fires still manage to burn out of control for weeks. Just recently wildfires have burned down entire communities, killing hundreds in Australia, Israel, and the US. These fires are extremely costly to fight usually requiring vast resources and man power. Additionally the risk of injury and death to fire fighters is very high as more than 45 first responders died in Israel and Texas during wild fire incidents in recent months.

SUMMARY

To summarize the new invention; The Rain Maker Wildfire Protection and Containment System in its preferred embodiment, is a self contained, robust, intelligent, rapidly deployable wildfire protection and containment system that can be deployed by smoke jumpers and metro fire personnel. The system components create a new method of protecting multi story building structures, subdivisions and the environment from an approaching of wildfire. The new invention provides first responders with a cost effective remote controlled (smart tool) protection and containment solution to wild land urban interface fires. The combined system components are capable of providing protection to villages, towns, cities or rural communities adjacent to wild land urban interface environments through a method or technique called layering. The system design and goal is to provide protection to building structures up to 10 stories or more. Additionally the system incorporates technology that transmits data from the fire zone to incident command, homeland security, analyst, and fire fighters on the ground in the danger zone, via onboard sensors, monitors, cameras, satellite imaging technology, GPS, and other wireless devices. Additionally the system incorporates zip line and grid track technology allowing the system to be elevated several stories above ground level to enable the blanketing effect on tall tree canopies and multi story building structures. Layering incorporates both ground level and above ground level protection by deploying zip line components built into both species of the Rain Maker invention see FIG. 1 and FIG. 1A. Additionally The name Rain Maker describes the blanketing effect the invention performs as it discharges high pressure suppressant skywards at high volumes e.g. 127,200 gallons per minute over a one mile stretch at top end capacity through it's plurality of commercial grade large diameter fire nozzles. 424 nozzles in a 1 long mile system×300 gallons per minute per nozzle=127,200 gpm. The system can be fitted with nozzles that can discharge higher volumes of water towards top capacity of 1000 gallons per minute per nozzle. To achieve this kind of volume would incorporate a series of portable high pressure and high volume pumps that are drafting from large water points such as reservoirs, lakes, ponds, and rivers etc. Booster pumps push water over long distances and help to maintain desired pressures at the Rain Maker nozzles. This would be the perfect scenario to contain large open wildfires covering a large open land mass such as the ones burning in Texas recently, which started very close a large lake at Possum Kingdom Texas.

The Fire nozzles are specifically designed for this system to discharge a variety of fire suppressants including mud slurries, chemical gel solutions, water or any liquid combinations to create super large combination fog pattern master streams. The Rain Maker in the first aspect as an emergency first responder smart tool is a preassembled hollow cylindrical conduit of a predetermined inside diameter and length made from light gauge steel, or aluminum alloy capable of with standing a combination of high pressure and high heat. Each Rain maker has a minimum of 6-8 commercial grade custom made combination automatic fire nozzles that are activated by remote control.

Plastic or PVC pipe is not recommended for this invention for obvious reasons. Plastic or PVC pipe can and will be compromised by the intense radiant and convection heat characteristic of a wild fire, as well as the abuse of being thrown around by fire fighters.

DESCRIPTION OF PRIOR ART

U.S. Pat. No. 7,644,776 B1. Issued Jan. 12, 2010 Holley, Fire Fighters Water Transfer Pipe. It provides a method of getting water to rural areas where fire hydrants are scarce or do not exist. This invention pertains to traditional methods of fire fighting—a fireman holding one hose and nozzle at the end of this invention. This design will not work in a large out of control wildfire for several reasons. The primary reason is it was not designed to fight a large open out of control wild land fire. The conduit material is plastic/PVC pipe which is vulnerable to heat and flames. Further it has no way of creating a containment line because it has no nozzles along its cross section. Once it has been deployed it relies totally on fire fighters to operate it the entire time it is being used and delivers water to the end of the pipe only. The limitations of the prior art are clear and would not offer much protection to fire fighters or homes in a large open hard to contain wildfire incident. The primary purpose of the prior art design seems to be to provide water to firemen in rural areas where hydrants are scarce or non existent for manageable structure fires or brush fires using conventional fire fighting equipment and methods.

Further the prior art offers no protection to an entire subdivision bordering wild land. Prior art incorporates no new technology that fire fighters could benefit from in a wildfire incident such as GPS, sensors, monitors satellite imaging and software. The prior art cannot be taken into mountain regions to fight a wild fire based on design and configuration which includes open water tank similar to that of an above ground swimming pool along with 6.5 ft PCV pipe. This is would not be an effective solution in a major wildfire situation. Currently when fire fighters need water they use water trucks called tenders, they carry approximately 3-4000 gallons of water full and are mobile at capacity. They are equipped with pumps and 100+ foot fire resistant hoses with quick couplings to carry the water long distances into remote or rural areas. It would take less time to connect 4-100 ft hoses together to move water 400 feet, than to connect 62-6.5 foot sections of PVC pipe.

DESCRIPTION OF PRIOR ART

U.S. Pat. No. 7,832,492B1 issued Nov. 16, 2010, to Eldridge. The prior art design and method are insufficient in providing protection to homes, and creating an effective fire break or containment line in large open wildfires, for the following reasons. Plastic or PVC pipe will quickly be compromised by radiant and convection heat generated from a large 200 foot wind driven wildfire with large fuel sources like tall trees and bushes present. Radiant and convection heat can melt plastic from a good distance away without flames ever touching the PVC pipe, the risk of this happening is 100%. Additionally the prevailing design of the preferred art seems to be small holes drilled in the pipe to create the sprinkler effect. This is evidenced by the specifications on page 4 next to the last paragraph; range of effective coverage stated in the patent; soaking vegetation to be approximately 30 feet wide×400 ft long according to the document of the preferred embodiment. The art also includes the dependency on existing fire trucks as part of the primary function to distribute retardant. Fire truck pumps are limited in pressure and flow rates over large linear distances. Since the prior art is relying on fire trucks for retardant and pumping as shown in the drawings and stated in the document, the math does not add up to equal an effective fire break over extended areas for sustained periods of time. Most fire engines have 500 gallon capacity water storage tanks, with the method stated in the prior art of 200-1000 gallons per minute, the pumper truck would be empty in approximately 3 minutes to 30 seconds.

Further it is stated that the preferred flow rate is believed to be 700 gallons per minute. Further the inventor emphasizes the goal of soaking vegetation, relating to grass and brush fires based on disclosed maximum ranges of soaking area of 30 ft×400 ft @ 700 gallons per minute. Wildfires climb trees and blow fire brands (embers) hundreds of feet into the air, this invention is confined to a ground level operation with limited flow rates by stated design, rendering it ineffective in creating a fire break in a large open wind driven wildfire event in any terrain and would be insufficient in providing adequate protection to homes or the environment. Additionally it appears to have multiple parts to be assembled i.e. the construction of laying pipe side by side to prevent rotation toward the ground. Any pipe under high pressure will rotate, having another pipe beside it that is not permanently attached via bolting or welding does not provide stability and reliability. He also mentioned that his system could be deployed close to the fire front; I don't believe this is possible with so many parts to put together. Fire fighters are putting their lives on the line to save homes and other structures, having effective, reliable, stable mitigation tools, systems and methods is a life and death concern. Additionally any conduit system is only as reliable as its weakest link; plastic is a very weak link at ground level. Thus wherever the breach or failure occurs in a conduit system it takes down the entire system rendering it inoperative thus creating a life and death situation for everyone involved including home owners, and you only get one chance to get it right. The prior art offers no new technology that brings it into the 21$^{st}$ century wildfire fighting arena. To provide the best wildfire containment and mitigation methods, a staging pre-plan is of the highest priority combined with robust preassembled equipment, support components and tactical methods that collapse the time frame on set up and deployment. As set up times are of critical importance and must be kept to a minimum. Prior art offers little value in the wildfire theater by its design. The Fire Fighters I collaborate with would not risk their lives relying on the prior art. It is clearly limited in scope and the ramifications are high risk and dangerous at a minimum. Additionally the diameter, arrangement and placement of apertures or holes in the pipe does not provide for a contiguous 360 spray pattern soaking, leaving dry areas between conduits which become ignition points providing a fire breach area. The primary goal of this invention is to soak vegetation at ground level through a plurality of drilled holes. Drilled holes will generally create a straight solid stream of water and not a spray; to create a spray a nozzle is required. The preferred art drawings do not show any fire nozzles attached to the apparatus at all, although they are mentioned as an after thought.

California has really big mountains I don't think there is a reel of 400 ft, three sided side by side attached flexible conduits that could traverse a tall hillside or mountain as limited conduit length (400 ft) the weight becomes a major factor for firemen to haul a sided hose uphill. Additionally how much hose can you place on one spool certainly not thousands of feet of complete three sided hose and if you are using fire trucks as your water source they are not configured to accommodate the design of the prior art. The inventor uses the word construction in his rapidly deployment scenario of the invention, fire fighters will cringe at the idea of spending hours constructing pipes side by side on the ground to get a 30 foot wide vegetation soaking putting their lives in harms way as wildfire can travel at speeds upwards 70-100 miles per hour.

SUMMARY OF THE INVENTION

The present invention relates to a fire containment system comprising at least one cylindrical metal conduit having forward and rear ends, and including at least six nozzles arranged thereupon to collectively spray and direct fire suppressant at arched angles with respect to the conduit in a vertical trajectory upwardly and away from the conduit in a 360 degree pattern to a height of up to five stories of reach from the conduit, with two nozzles present on each longitudinal cross-section of the conduit and at least one nozzle near each end, with each nozzle being a commercial grade fire nozzle capable of delivering at least 300 gallons to 1000 per minute when operatively associated with an appropriate source of fire suppressant and high pressure pumping equipment.

The invention also relates to a method for containing a fire which comprises arranging one of the fire containment systems disclosed herein that include one or a plurality of conduits and respective fire nozzles adjacent to a fire or in the path of a wildfire; providing fire suppressant to the conduit(s) and spraying and directing the fire suppressant upon or in front of the fire to prevent the fire from spreading. The fire suppressant is preferably a suppressant slurry, gel mix or water, and is sprayed at a rate of 1800 to 8000 gallons per minute per conduit to starve the fire of fuel sources.

The rain maker in its original design is a rapidly deployable intelligent wildfire protection and containment system utilizing satellite imaging, gps, monitors, heat and wind sensors digital cameras and other wireless technology and hand held wireless devices: The system may be deployed via helicopter or flatbed tractor, or other type heavy duty tractor/truck. The preferred embodiment comprises a system including high pressure high volume pump and distribution technology used by first responders in an emergency response wildfire incident. The various components comprise a system and a new method of external robust wildfire protection and, containment, vastly different from any other system. The system creates a best practice cost effectively controlling the spread of wildfire to single family dwellings, multi story building structures, historic land marks, government buildings and the environment faster than conventional methods. The combined system components are capable of providing protection to a city, entire subdivision, neighborhood, town, village or rural community in wild land urban interface environments. The system helps fire fighters prepare a staging pre-plan of attack, containment, and protection to homes, commercial building campuses using satellite imaging like Google earth combined with topography and gis mapping technology software. By subscribing to a 24 hour manned pre-planning wildfire containment service, fire fighters will have a powerful medium to collaborate on methods and preferred staging areas. With this service fire fighters will have eyes in the sky looking at their respective wildfire events on the ground, assisting them with staging times i.e. how much time they have to mobilize to staging area and determining the mode of transport by chopper or trucks, and ATVs.

The Rain Maker wildfire protection and containment system is a first responder smart tool used to protect homes, cities, villages, towns, subdivision and neighborhoods. The system incorporates GPS, satellite imaging, sensors that detect temperature, wind speed, and directional movement of the fire and tracks first responders on the ground, sends and receives real time data to incident command. The above mentioned technology is an optional add on package to those fire departments who want it. The Imaging service and associated technologies determines how much set up time first responders will have before the area becomes too dangerous to set up Rain Maker System or other equipment. The Rain Maker Wildfire Protection and Containment System combines state of the art 21$^{st}$ century technology with powerful pumping and distribution technology to create a uniquely powerful cost effective protection and containment solution in wild land fire incidents.

The components that make up the Rain Maker Wildfire protection and containment system can be manufactured to specification for desired application, causing slight changes and adjustments to tanks, pumps, and things like the inside diameters and lengths of the conduit, fire nozzle diameters and design, base plates, weld seams, wall thicknesses, added safety features etc without leaving the spirit of the original design. The Rain Maker System creates the 360 degree fire suppressant discharge pattern at a range of more than 2000 gpm on the low end and considerably more on the high end in gallons per minute, that can reach more the five stories skyward at arched angles from ground level to blanket and treat tree canopy foliage, and all surrounding vegetation and multi storied building structures, it will blanket everything within a 100+ foot wide range, combining reach of nozzles on both sides of the conduit. The test results yielded approximately 55 ft of reach per each side of Rain Maker conduit totaling 110 ft at 110 psi using water only. Additionally, the system can traverse and treat large areas of land covering distances in excess of 5280 linear feet or one mile. By combining the conduits with wireless technologies and a pre-planning service, a robust new method and best practice is created to protect homes, save lives, and control the spread of wildfire over long distances.

The system can be deployed by a small strike team of a 10-20 men and or women. To cover a containment line of 1 mile the system is set up and when fully operational it would represent the equivalent of about 480 virtual fire fighters as each The Rain Maker is armed with approximately 8 professional commercial grade high capacity combination fog automatic fire nozzles each, with an output range from 75 to 500 gallons per minute each. Example, to deploy a system covering one linear mile or 5280 feet, would consist of approximately 60 Rain Maker Conduits times 8 fire nozzles each equals 480 nozzles total times 95 gallons per min equals 45,600 gallons per min. Because of the range of 5 stories, the spray pattern assimilates the rain effect, thus was born the name the Rain Maker. The good news is fire fighters would not be required to hold any of the nozzles or stay in the fire zone as the system will do the job itself once fully set up and activated by a remote transmitter to contain and provide significant mitigation to the oncoming wildfire and to prevent its spreading into communities, and towns. Additionally keeping first responders out of harms way, reduces injuries and death, this particular attribute of the present invention is the most important in my opinion.

Additionally the System can draw water from reservoirs, lakes, ponds swimming pools, rivers, oceans, streams etc. Additionally the Rain Maker System can be retrofitted on a home lot, into commercial campus sites, or upon a nuclear reactor site such as the one in Japan that was compromised. If a Rain Maker system was in place it could have pulled water directly from the ocean to cool the breached reactor without personnel being in harms way. Any commercial or residential new construction building project could incorporate a monitored Rain Maker system in its alternative embodiment incorporating sensors, software and wireless technology as an external preventive fire protection system. Insurance companies offer incentives to home owners and commercial building owners for hard wired fire suppression systems.

Additionally this system and its method of protection and containment will save state and federal governments billions of dollars in cost to fight wildfire annually. The state of CA spends approximately 800 million per year to fight wildfire according to Cal Fires website. The present invention and new method of layering creates a defense and an offensive plan to contain wildfire faster saving the state of CA at least 100 to 200 million per year in cost the first 5 years even more in subsequent years as fire fighters become more familiar with the technology. A complete system with all the bells and whistles would only cost a fraction of the money saved, paying for itself completely by the $2^{nd}$ or $3^{rd}$ year of implementation.

The system can be installed (hard wired) in a variety of commercial applications large or small, e.g. schools, high risk manufacturing plants as well as petro chemical processing plants, commercial farming operations and wild life sanctuaries to name a few. The Rain Maker conduit can be manufacture or constructed to fit many applications that will cause a change to inside diameters and lengths, fire nozzle sizes and design, as well as additional safety features. The Rain Maker System can also be included upon a Utility Vehicle to be a unique technique of fighting wildfire. It incorporates the pre-plan dictating how many systems to deploy, of what type conduit, based on topography and at what locations deployment should occur. By utilizing this technique of deploying multiple Rain Maker complete systems to multiple strategic locations according to the pre-plan, effective protection and containment of wildfire can be achieved, resulting in extinguishing the fire sooner.

Additionally an alternative use of the system is the combination of multiple conduits to create a method of protecting buildings, the environment utilizing a combination of the technologies-including (remote controlled grids consisting of tracks and motorized winches, and hydraulics not shown). One of the more important components of the Rain Maker system is the Rain Maker All Terrain Multi Utility Vehicle that can be operated by remote control or manually. It was designed to facilitate one aspect of overhead deployment and layering of the Invention. When a wildfire occurs in a mountain region the system can be deployed into the mountains to create a containment line above the tree canopy. This is accomplished by satellite imaging and Google earth technology. Satellite images are taken of the fire zone, the pictures are analyzed for possible staging positions on top of mountains facing each other above the fire are far enough away create a safe staging (set up) area. An air crane would be necessary to airlift the Rain Maker system into the mountain positions picked by incident command as a setup platform to deploy the system ahead of an approaching fire.

This type of deployment to achieve containment from the mountain tops is as follows. Once a pre-staging plan is complete, three mountain top positions are chosen to surround the on-coming wild fire. Three Utility vehicles are deployed one to each mountain top position; along with a number of 6900 gallon open top storage tanks which are flown into the designated positions on the mountain tops. The tanks will have their man holes open to be refilled with gel fire suppressant and slurry mixes, each tank has a built-in mixer impeller.

The utility vehicle has the following onboard equipment: generator with AC/DC outlets, tool boxes and storage bins, high powered work lights and spot lights, drinking water storage tank, specialty fire hoses with commercial grade fire nozzles, automatic remote operated monitor nozzles front and rear so that operator can spray down surrounding area with suppressant if needed while driving the vehicle. The utility vehicle has a powerful diesel engine, a minimum of two onboard mechanical winches, and a telescoping hydraulic mast capable of raising to an adjustable elevated height above the vehicle to deploy 20 zip line cables, along with special fire hose of predetermined lengths (not shown) and a hydraulic work platform that will accommodate minimum of two people, steering and maneuvering controls that operate manually and by wireless remote control. The utility vehicle also has a shovel/blade on the front capable of clearing brush so to create a clean working space quickly. The vehicle has hydraulic mechanical arms or clamping devices that assist in grabbing trees to throw after they have been cut and to anchor vehicle to tree to set up for deployment of the overhead cables. The utility vehicle is equipped with both manual and automatic hydraulic outrigger leveling system to level vehicle on uneven terrain. The utility vehicle will be equipped with safety appliances, including secondary communication devices, GPS, onboard detachable computer. The utility vehicle has airlift apparatus allowing it to be picked up and flown to staging area by air crane helicopter for rapid deployment.

The Rain Maker System and all components necessary for mountain and wild land deployment as a complete self contained system have airlift apparatus for rapid deployment. The utility vehicle is equipped with an audible early warning alarm system that notifies the set up team of how much time is left for set up, and time left to activate system. To connect or merge two utility vehicles' respective zip line cables together, the cable of the first vehicle connects to the cable of second vehicle. Each zip line cable has a connection coupling device at the end of each cable that interlocks with the other to form one continuous length of zip line cable. The air crane is needed to accomplish this task by hovering one utility vehicle over the other utility vehicle. The vehicle attached to chopper is secure with no rotational or side to side swinging movement; the vehicle on the ground is anchored to a tree with the hydraulic anchor arms FIG. 2. Each vehicle will have its high capacity winch spool set to neutral, allowing zip line cable on both to free spool, releasing cable on both vehicles. The air crane can then fly the second vehicle its carrying to its designated position to execute and complete the staging plan. There are other practical ways of connecting the cables to two utility vehicles using the ground crew and special attachments for choppers (not shown). The utility vehicle is also equipped with an articulated hydraulic robotic arm and detachable rotary saw attachment capable of cutting the tops out of trees and pushing them away from the vehicle this action is necessary to clear the air space above the hydraulic telescoping mast, (arm and other features mentioned herein). The multi purpose utility vehicle with stated features is an essential 21st century smart tool providing first responders with an best practice strategy in the effort to mitigate, contain, and protect people, homes, commercial buildings, harvestable agriculture including trees, national forest, wildlife management and other protected lands from the devastation of wildfire.

When all the components of the stated invention are used together they create an effective protection and containment strategy against wildfire. As stated in the above claims the environmental impact of wildfire will be greatly reduced preserving the forest eco-system, wildlife, endangered species, and protected land management areas. As stated above in the claims by containing wildfire sooner in hilly mountainous areas like California would result in fewer mud slides as vast amounts of vegetation would be preserved. The Rain Maker Conduit devices can traverse zip line cable with ease over long distances. As stated above the utility vehicle winch mechanism will retrieve the Rain Makers deployed on the zip line cable when operation is over. The system can be deployed in layers; meaning multiple systems deployed in various locations to strategically protect designated areas, as well as creating multiple fire containment perimeters as needed based on the pre staging plan.

A Rain Maker Grid is also contemplated by the invention. It is an elevated steel bridged framework of tracks, cables and or supports that allow the Rain Maker conduits to traverse the expanse from point A to B by remote control to discharge suppressant or water from an overhead position above the campus or neighborhood protecting large areas from wildfire as a preventive and preemptive measure.

OBJECTS AND ADVANTAGES

The objects and advantages of my invention are its flexibility and mobility for rapid deployment, along with its vast operating range of several square miles of deployment at ground level or overhead both FIGS. 1 and 1*a* with zip line attachment. The fire protection and containment system can be moved into place by truck or helicopter and setup quickly. System Set Up is accomplished by a small task force of first responders approximately 10-40 fire fighters or smoke jumpers using both 4 wheel drive ATVs, helicopters and The Rain Maker multi purpose all terrain utility vehicle (RMATUV). The following is a snap shot of a complete system deployed over several linear miles utilizing lake water as a suppressant. Example: three hundred rain makers FIG. 1 and 1*a*. Fifteen 21 thousand gallon mobile storage tanks and ten 6900 gallon mobile storage tanks as depicted in FIG. 4. Ten Rain Maker all terrain utility vehicles (RMATUV), six 4 wheel drive ATVS, Pump booster manifold (not shown) support tools, forest heat resistant hose and other equipment. Ten high pressure high volume pumps as illustrated in FIG. 3, although all 10 pumps may not be required, I would have them available on or near the staging site just in case. This example could create more than one containment and protection line totaling approximately 5-10 linear miles using the layering technique and depending on terrain and topography. Additionally once the system covering 5 miles is set up and fully operational it would represent the equivalent of about 2400 virtual fire fighters-fighting at 360 degrees at each rain maker unit. However in this scenario the handful of fire fighters 20-50 that set up the 5+mile system would not be required to stay with the system or hold any of the nozzles—the system will do the job itself upon activation. This is accomplished by a remote control transmitter or other wireless device. The above described method would stop, slow down, and contain an approaching wildfire, preventing it from spreading into a at risk neighborhood. This new method of containment and protection has never been implemented or seen to my knowledge.

The system comprises a wildfire protection and containment method, and smart tools provided to first responders to assist in preventing and controlling the spread of wild fire in wild land and urban interface environments in its preferred embodiment. It is capable of protecting an entire subdivision, township or city, using the technique called layering described above. Layering is a series of multiple complete systems at multiple locations simultaneously cutting the fire off at multiple locations using a pre-planned staging process which incorporates satellite imaging and other technology. This method is the only practical and safe method of providing an effective protection and containment solution removing fire fighters from the most dangerous areas of the wildfire zone.

The system and new method of containment would provide more accurate suppressant coverage. This is done by spraying fire suppressant in a 360 degree pattern above a tree canopies using FIG. 1*a* and FIG. 2-4 together. This method provides a 100 ft wide contiguous fire suppressant blanket covering all fuel sources in its path thus creating containment line.

To provide a safer method of protecting homes and building structures in an entire subdivision bordering wild land urban interface environments from wildfire. While allowing fire fighters to operate the system to their advantage and remain at a safe distance from the affected wildfire zone.

Another advantage, this system offers to fire fighters is the incorporation of sensors, monitors, cameras, GPS, and software technology. This allows fire fighters greater control and to receive more accurate real time information about the wild fires movement and other conditions on the ground vital to their safety, and the safety of the community.

Another advantage is the type of custom commercial grade Fire nozzle used to make up the configuration of nozzles on each rain maker. The result of this important strategic technological advancement creates the virtual heat resistant fire fighter fighting at a 360 degree radius. Each Rain Maker is the equivalent of 8 fire fighters in a 4-6 inch inside diameter×40-48 inch long preassembled fire fighting conduit armed with quick connect couplings, a rigid handle or leather carry strap, a base plate that allows it to sit flat on the ground, on rough terrain it can be nailed down with 2-12 inch spikes.

Another advantage of the invention's main embodiment, is its light weight, manageable, rugged capable of with standing sustained fire fighters handling. It is also high heat resistant, and will not melt by radiant and convection heat.

Another advantage of the type of fire nozzle design, and angle of placement on the invention makes it very robust when discharging at high pressures around 120 psi, providing up to 5 stories of reach from the ground level this was confirmed in the first test on Dec. 2, 2009 with the fire department.

The invention is entirely self contained and can operate independently of other municipal fire fighting apparatus. Additionally it can be activated by remote control transmitter or smart phone mobile technology keeping fire fighters at a safe distance from the main fire.

Additionally the system can be set up on a custom designed trailer made specifically for the invention, and be towed into an affected community and deployed faster because on the trailer several rain makers are already connected you simply connect the at the end of each trailer by a predetermined length of hose, similar to connecting air brakes on a series of train cars.

An alternative use of the present invention; the rain maker system can be retrofitted into the infrastructure around a single family dwelling, commercial complex, city, town, village, refinery, subdivision, building structure or neighborhood.

REFERENCE NUMERALS TO DRAWINGS

Figure 1:
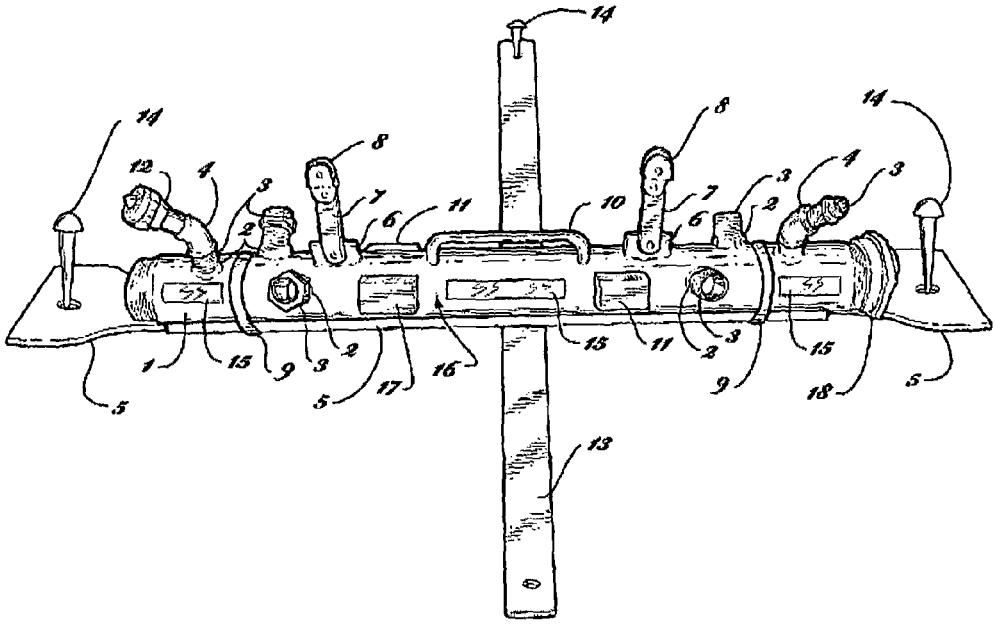
FIG. 1 Shows an individual Rain Maker conduit fire protection apparatus made of light weight heat resistant metal alloy. This embodiment can be used at ground level or overhead with the use of the fold out zip line apparatus located on top ref 6-8.
Figure 1A:
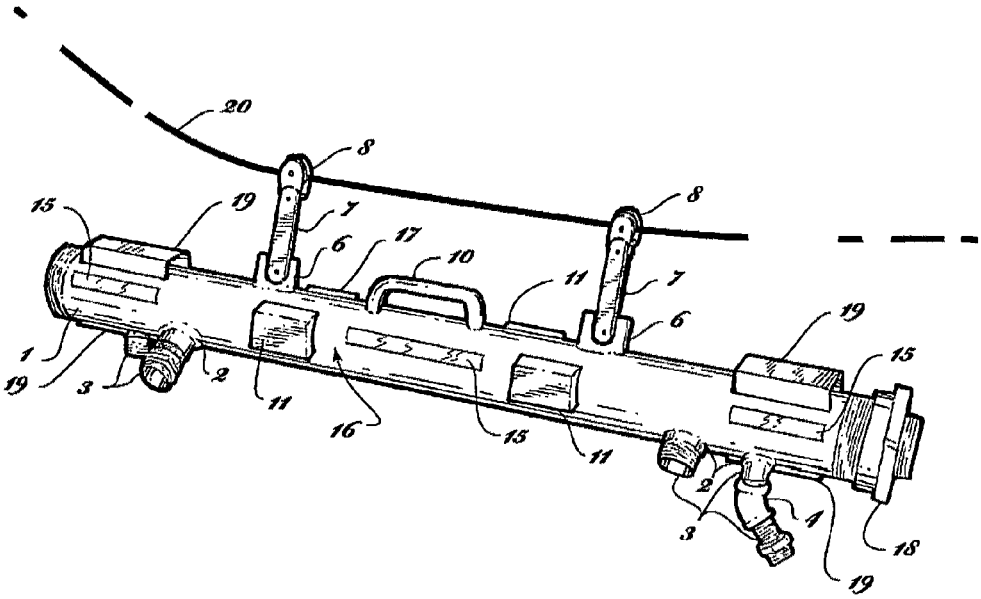
FIG. 1*a* Shows a similar Rain Maker apparatus designed for overhead use only, it is also made of light weight heat resistant metal alloy traversing zip line cable 20.
Figure 2:
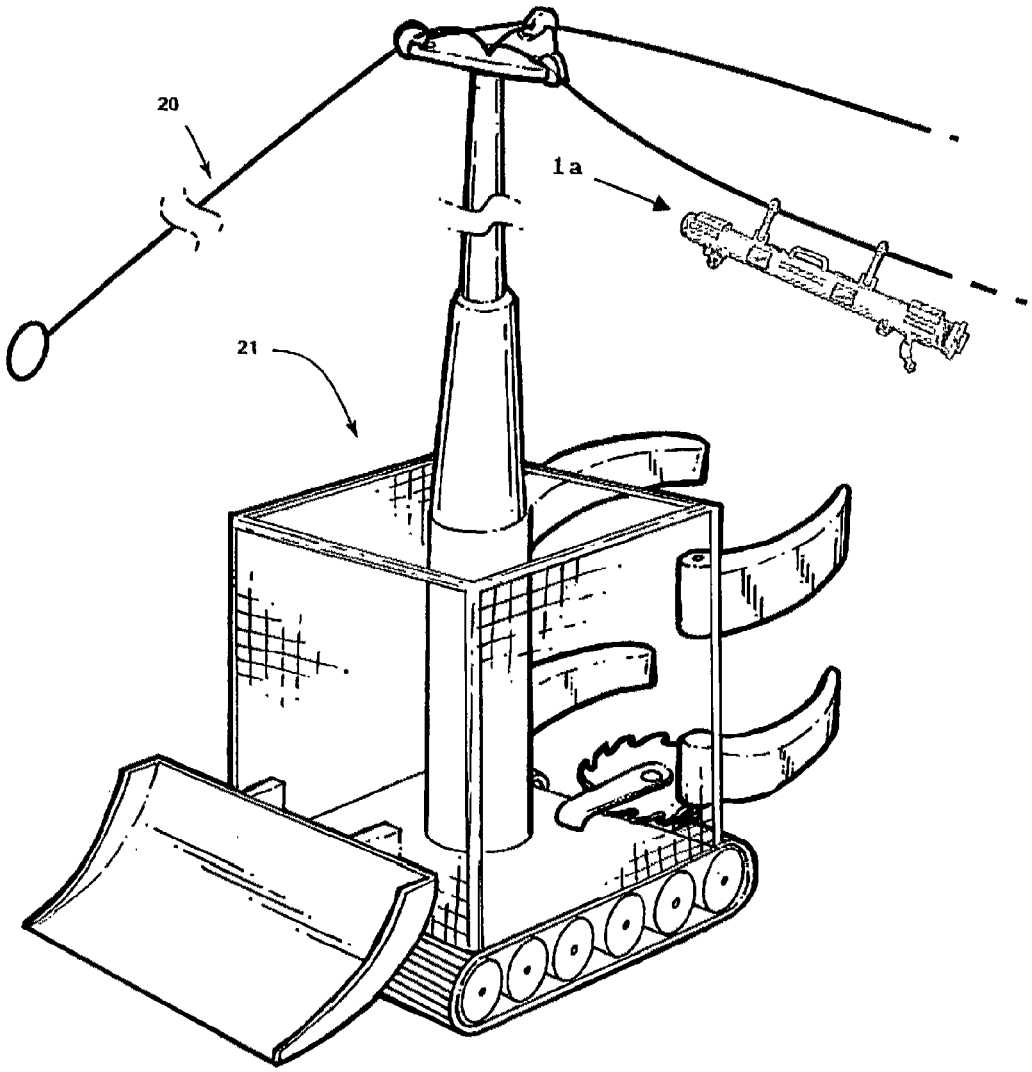
FIG. 2 Shows a Rain Maker all terrain utility vehicle components 21. It's made of light weight aluminum alloy, it is a multi purpose self propelled track vehicle with an open work platform within its walls. It has a hydraulic telescoping member that is used raise FIG. 1*a* above the tree canopy to facilitate overhead deployment by traversing zip line cable 20 to other all terrain utility vehicles 21 as needed utilizing a series of onboard mechanized winches (not shown).

1 Rain maker pipe conduit FIG. 1
1*a* Rain Maker pipe conduit FIG. 1*a*
2 Threaded pipe fitting
3 Male threaded pipe nipple
4 Threaded elbow 45 degrees
5 Main pipe support channel base plate
6 Main trolley support bracket
7 Trolley extension bracket
8 Zip line trolley wheel assembly
9 Main pipe support channel base plate retainer clamp
10 Carry handle/strap
11 Bracket for sensors, monitors, GPS, and wireless devices
12 Adjustable combination fire nozzles
13 Horizontal folding anchor plate
14 Metal stakes
15 Reflective marking tape
16 Glow in the dark paint
17 High intensity strobe lights
18 Fire hose quick connect
19 Stacking plate
20 Zip line cable
21 Rain Maker All Terrain Multi Purpose Utility Vehicle

DETAILED DESCRIPTION OF THE INVENTION

FIGS. 1 and 1*a* The preferred embodiment of the present invention designed for emergency first response is illustrated in FIGS. 1 and 1*a* (top side view). The Rain Maker pipe conduit 1 is a hollow preassembled cylindrical metal pipe of predetermined diameter and length threaded at each end to accommodate quick connect couplings and a cap on the lead unit to build pressure in the system. Holes are then cut along the longitudinal cross sections at a certain points and angles to create the 360 discharge pattern, and to allow threaded pipe fitting 2 to be inserted and welded into place on 1 and 1*a*. Pipe nipples 3 are then threaded into fitting 2. Fire nozzle 12 is then threaded onto all pipe nipples 3. 45 degree female elbow 4 is threaded onto pipe nipple 3 on top at each end of 1. (note 2 additional nipples will be added to top at both ends of 1 and 1*a* to add 2 more fire nozzles for a total of 8 on each the first responder versions not shown in drawings 1 and 1*a*) (Additionally an automatic drain valve will be included all 1 and 1*a* units to release any residual fluid and pressure stored in 1 and 1*a* not shown in drawing) Main pipe channel support base plate 5 is secured to 1 by retainer clamp 9 and spot weld along longitudinal cross section of 1 at base plate 5 in four places. Carry handle 10 is secured to main pipe conduit 1 by welding. Strobe light 17 is secured to main pipe 1 with adhesive. Bracket containing box with digital instrumentation cluster, GPS, sensors, including wireless technology, is spot welded to main pipe 1. Horizontal anchor plate 13 is secured to bottom of base plate 5 by one flat ½" flat head bolt, and lock nut and locking pin. Trolley support bracket 6 is welded to main pipe body 1. Trolley extension bracket 7 is bolted to 6 with ⅜ hex bolt and lock nut snug tightened to allow extension bracket to fold down next to main body of 1 and 1*a*. Zip line trolley wheel 8 is attached to 7 by grade 8 bolts and lock nut. Rain maker assembly is then painted with glow in the dark paint 16. Reflective marking tape 15 is added in various locations on 1. Each preassembled Rain maker can be connected to the next in a series via custom specialty heat resistant forestry fire hose of a predetermined length approximately 100 ft long connected at each end of FIG. 1 Rain maker unit covering long distances of more than one linear mile. This allows the system the flexibility to go anywhere in any type terrain creating a contiguous wall of fire suppressant in uniform coverage with a 360 degree spray pattern at predetermined arched angles on each fire nozzle at 40 and 45 degrees angles. The metal stakes 14 or sand bags can be used to anchor 1 to the ground when positioned on paved or non paved surface.

FIG. 1*a* (Side view) of the preferred embodiment is constructed similarly to 1 as illustrated utilizing all of the components of FIG. 1 drawing, except item numbers 5, 13, 9 and 14 are not required due to 1*a* being dedicated to zip line deployment. This is primarily due to this version providing an alternative use in the layering technique mentioned above as one of the overhead deployment technique using the utility vehicle 21 and the zip line component 20.

Figure 3:
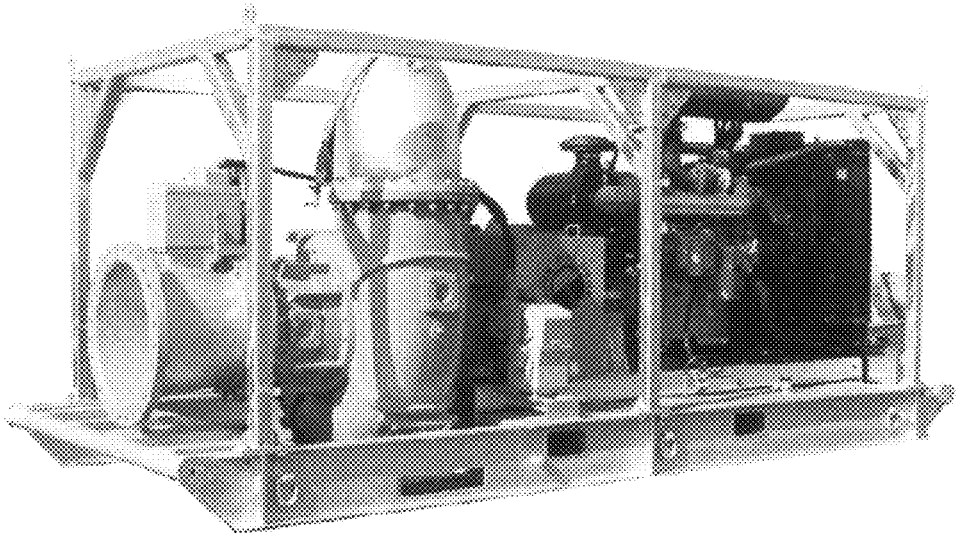
FIG. 3 Shows various types of mobile self contained high pressure high volume diesel powered liquid pumps that connect 1 and 1*a* to FIG. 4. These illustrated pump components are an integral part of the overall Rain Maker System both can be air lifted by an air crane (helicopter) The 2 pumps shown can move 44,000 gallons per minute, add 3 more 28,000 gpm pumps to the equation to increase volume to 128,000 gallons per min combined.
Figure 3:
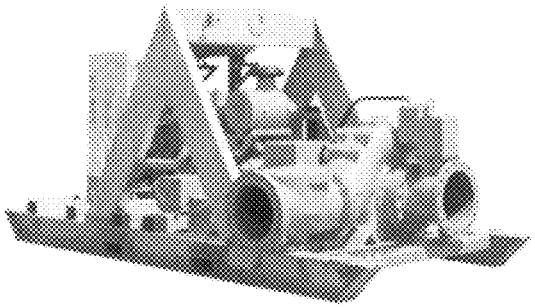

FIG. 2 Top (side view) describes a self propelled mobile track utility vehicle having a open work platform, a telescoping hydraulic mast, front 6 way shovel, 2 articulated saw arms and multiple winches, cables, steering mechanism and a leveling system. It also utilizes GPS technology, software, satellite and wireless technology to send data to incident command and ground troops in real time. It can be deployed on hill tops to clear brush and fuel loads and to deploy telescoping member above tree canopy to allow Rain maker to traverse cable 20 in an overhead position to prevent tree canopy fires from advancing. Canopy fires are commonly referred to as ladder fires by fire service professionals. When using the utility vehicle, multiple utility vehicles 21 should be used to inter-connect zip line cables 20 to each mobile unit 21 setting 180 degrees opposite the other interface utility vehicle RMATUV. This new method of starving a wildfire of canopy fuel is novel and unique. All the components that comprise the Rain Maker fire protection and containment system when working together provide a high tech robust wildfire protection and containment system. A hard draft hose can be used where natural water points such as lakes, rivers, ponds or reservoirs are available to feed Rain Maker 1 and 1*a*. When all components are connected, a number of suppressants can be deployed based on availability, and vegetation fuel load status and other ambient conditions. FIG. 3 represents the mobile pumps used to connect new invention 1 and 1*a* to suppressant storage/mix tanks. Additionally this vehicle is capable of cutting down trees in seconds or removing the tops and limbs interfering with deployment of 1 and 1*a*. It has GPS, sensors and monitors onboard that send and receive information to and from incident command. It also incorporates hydraulic leveling along with a hydraulic anchoring system that locks around a tree trunk to solid stable anchoring to deploy mast and zip line cable 20 and rain maker 1*a*.

Figure 4:
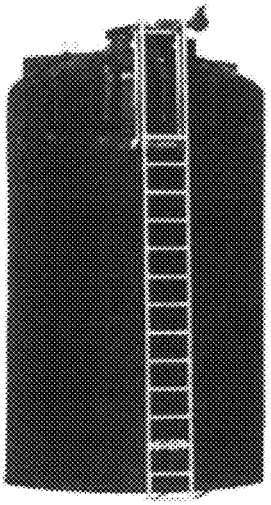
FIG. 4 Shows example of mobile, mixing/fire suppressant storage tanks used to deliver suppressant to fire pumps FIG. 3.
Figure 4:
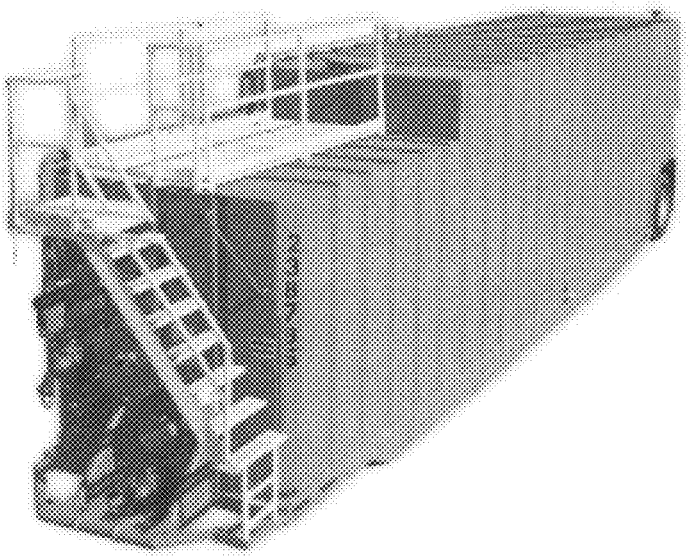
Figure 5:
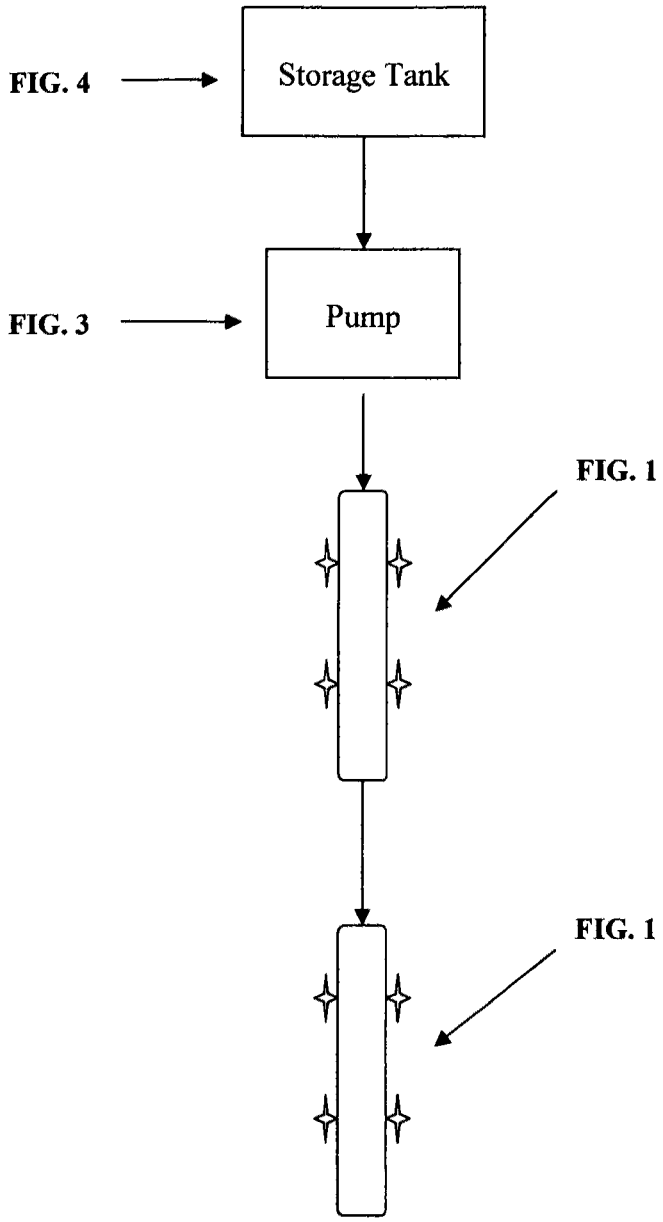
FIG. 5 Shows a diagram of how FIGS. 4, 3 and 1 connect to one another via fire hose.
Figure 6:
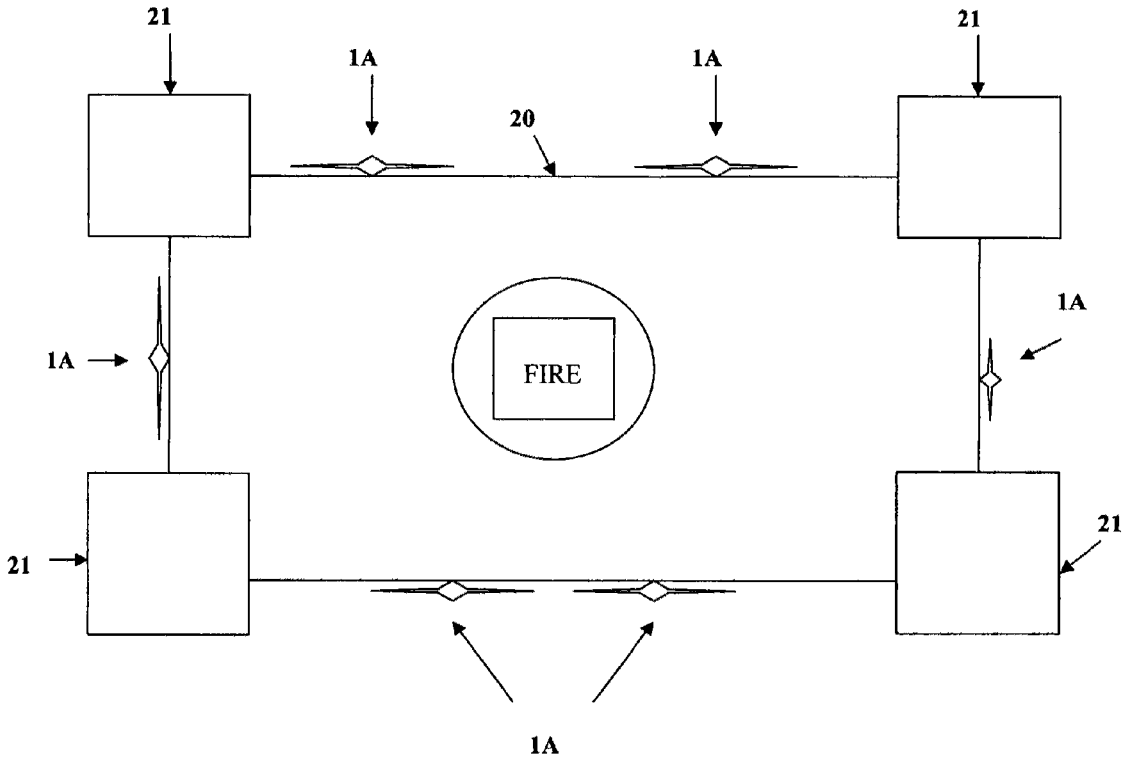
FIG. 6 Shows a diagram of 4 Rain maker utility vehicles 21 inter-connecting via cable 20 in an overhead containment effort on hill tops above the tree canopy, effectively surrounding the wildfire cutting it off. The star symbols on the cable 20 represent the Rain maker invention 1*a* or 1*a* respectively. This illustration shows 1*a* discharging fire suppressant from an overhead position (above the tree canopy).

FIG. 4 is an example of various mobile liquid storage tanks needed to feed suppressant to 1 and 1*a*. FIG. 5 is a diagram showing how the system components connect to one another, storage tank connecting to pumps by fire hose and then to Rain Maker apparatus FIG. 1 and 1*a* by a predetermined length of fire hose. FIG. 6 Is a diagram of multiple track vehicles inter-connecting around a fire by zip line cable 20.

Figure 7:
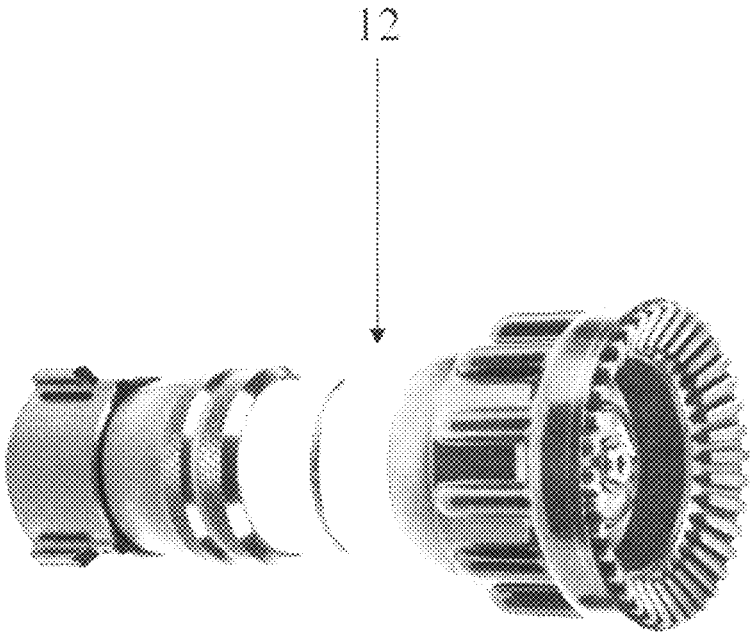
FIG. 7 Illustrates the type of commercial grade combination fire nozzles that will be utilized on 1-1*a* respectively. At least 6-8 nozzles are attached to each Rain Maker unit minimum (not shown). Two large diameter automatic fog nozzles per longitudinal cross sectional side=4 and 2-4 large diameter nozzles located on top, 1-2 at each end of Rain Maker conduit. The type of nozzle, configuration and placement angle on cross section of 1, and number of nozzles 12 is critical to the performance of each Rain Maker unit. It also determines the 360 degree contiguous discharge pattern effectiveness. As well as vertical trajectory of suppressant, further it is critically important to obtain maximum vertical range at the optimum nozzle pressures.
Figure 4:
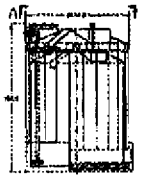
Figure 4:
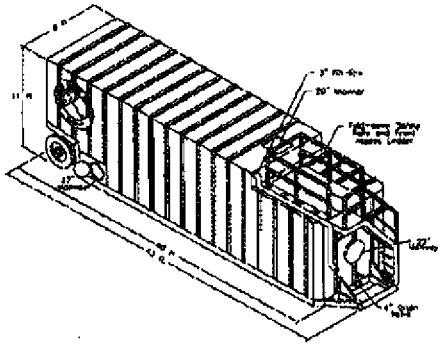
Figure 7:
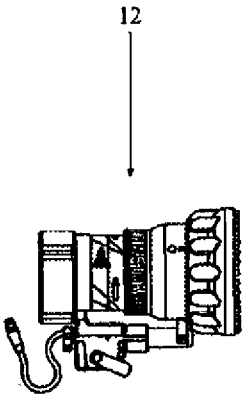

FIG. 7 Illustrates the type of commercial fire nozzle that will be attached to the main embodiment FIGS. 1 and 1*a* of the new invention the Rain Maker. A minimum of 6 fire nozzles are attached to each Rain Maker to create a 360 degree discharge pattern of suppressant.

Alternative Use of the Preferred Embodiment

The alternative use of the Rain Maker system design is preventive and preemptive in nature. In other words, the hardware can be permanently installed to existing or new infrastructure projects. Installing this system will prevent the spread of wildfire into the protected areas. It can be scaled to fit small and large applications. For example, around any single family dwelling, entire subdivisions, villages, ecosystem sanctuaries, landmarks, oil refineries, power plants, nuclear reactors, oil drilling platforms, military installations, and schools to mention just a few. To accomplish this, the property would be measured and a system custom designed and engineered to fit the size of the property and topography. A custom design system will take into account many factors to determine size and scale of the system components. Examples are inside diameter of conduit, size of nozzles, direction of trajectory, remote sensors, GPS, cameras, fully automatic and manual operation, pump sizes, and water points and other suppressants desired. Additionally mounting system on a grid, track/rail similar to a roller coaster rail or other type of constructed framework could be beneficial in high risk communities living with the threat of a possible deadly wildfire such as Oakland Hills Calif.

A custom rain maker system would incorporate some of the same advanced technology as its commercial rapid deployment counter part, i.e. sensors monitors and wireless technology and remote activation. Bringing these components together would provide a more robust self contained external, monitored, fire protection system for single family and commercial buildings, nuclear reactors, on and off shore oil drilling platforms and refinery applications.

The system would only depend on a municipal water supply to initially fill its storage tanks but draw from its own storage tank when the system is activated. A water feed line would automatically be activated to replenish storage tank when water level reaches a set point level.

Operation of Invention

In an emergency wildfire event usually the fire department would be the first responder. The invention will be deployed by the fire fighting teams as follows. The Rain Maker self contained wildfire protection system comprising FIG. 1, 1*a*, and FIG. 3 and FIG. 4, along with accessories would be brought to the fire scene by truck or helicopter. A pre-staging/deployment plan is developed based on all available data about the approaching fire, the area, topography, wind speed, fuel loads, (vegetation & buildings) and available water points, including ponds lakes and streams. Once a pre staging plan has been created the fire fighters would begin to deploy system by connecting FIG. 1 connects to the next 1 by a predetermined length of fire hose. Enough rain maker 1 will be connected together by a predetermined length of quick connect fire hose, if 1 is staged on an unpaved surface then stakes 14 are driven through the anchor plate 13 and base plate 5. Enough rain maker 1 can be connected together to wrap around the perimeter of a subdivision bordering the wild land effectively creating a containment barrier between the wildfire fire and the subdivision. As many FIG. 4-21 thousand gallon storage tanks are staged as needed nearby and several four and five inch fire hydrants draft hoses will feed into the larger twenty one thousand gallon storage tanks. Hydrants discharge at various flow rates so it will be necessary to use multiple hydrants to feed each tank FIG. 4. The smaller tanks FIG. 4 are used in overhead deployments scenarios.

Once all required components are properly connected, the diesel and or gas powered suppressant pumps 3 are started and check for proper performance. When all checks out and the green light is given by incident command to activate system. Fire fighters when then retreat to a safe location activate the pumps which feed the Rain Maker 1 with high pressure delivery of high volumes of suppressant in a 360 degree contiguous pattern covering everything within a 120+ foot wide coverage area more than four stories from the ground. Because the system is flexible and multi purpose in design comprising thousands of individual components, as many systems can be deployed as are required to create containment barriers and protection to building structures wherever needed. This is called layering.

I will address the term Layering, It describes deploying multiple complete or partial systems in multiple locations as required to achieve the desired goal of protection and containment. An example of layering is deploying 2 complete systems of 400 or more FIG. 1 connected by fire hoses to multiple FIGS. 3 and 4, traversing thousands of linear feet over any type terrain. The very last FIG. 1 is capped off at the end to build pressure in the system forcing the suppressant to be discharged in a 360 degree pattern through hundreds of fire nozzles 12. On one side of the Rain Maker cross section, the suppressant is direct through fire nozzles 12 toward the fire. On the opposite side the nozzles are discharging toward the dry fuel vegetation or building structures. This method is both defensive and offensive. It is designed to coat everything strategically and not sporadically. Each rain maker 1 and 1*a* has a reach of about 60-70 feet per side at 120 psi in a 20 mph wind. Realizing wildfires create their own wind upward 70+ mph; the layering technique can be an effective method of defense and prevention based on topography and other prevailing factors. All of the above mentioned, creates the rain effect by discharging suppressant upwards towards the roof and walls of buildings covering them completely as well as vegetation and other potential fuel sources. Additionally Rain maker FIG. 1 can be deployed both at ground level and overhead respectively using utility vehicle 21. FIG. 1 being connected to 20 with utility vehicle 21 being used to deploy several FIG. 1*s* in a straight line. This method gives the discharge higher reach into tree canopy's and taller buildings creating the rain effect in a 360 degree pattern.

Another preferred embodiment of the Rain maker FIG. 1*a* is specifically designed for use in an over head attack position to contain wildfire in mountainous regions is as follows. A pre-staging plan would be developed by incident command using a service that provides satellite imaging and mapping combined with weather service data in the wildfire area. The preplan would give the fire service command invaluable information about where to deploy the Rain Maker system around the wildfire. Assuming a wildfire event in a mountainous region has been reported. All pre-staged Rain maker components comprising the system FIG. 1*a* and FIG. 1 stored in a storage container equipped with airlift apparatus containing no less than one hundred FIGS. 1 and 1*a*. Along with hoses and other accessories, and tools are deployed by helicopter into pre-planned staging area by a small 4-8 man deployment teams per system. FIG. 2-4 are also airlifted to the same locations. FIG. 2 Utility vehicles are situated opposite each other on hill tops inter-connected by zip line cables using helicopters. FIG. 2 is capable of clearing trees and brush creating a clean set up area. Once a suitable area is prepared The system components are connected together by fire hose and the invention FIG. 1*a* is deployed onto zip line cable 20 in a train of multiple FIG. 1*a* inter-connected by individual predetermined lengths of special fire hose. FIG. 2 telescoping hydraulic mast is raised to a desired height and 1*a* train deployed smoothly traversing zip line. FIG. 1*a* the train (a series of 1*a* units inter-connected by fire hose) traversing the zip line cable 20 above the tree canopy. The smaller FIG. 4 open top suppressant storage tanks filled with the suppressant of choice such as slurries or gel when water is not readily available, FIG. 4 open top tanks can be refilled by air crane chopper. FIG. 4 is connected to FIG. 3 pump, is connected to Rain maker train by fire hose. FIG. 1*a* train is deployed by crawler mechanism winch device and gravity above tree canopy ahead of the wildfire, once in position system is activated to discharge suppressant with great force at 60-80 foot wide all nozzles firing simultaneously on both sides and bottom of FIG. 1*a*. A contiguous application of suppressant is blown into the tree canopy foliage and ground fuels to treat with water or other chemical slurry. This new method would coat fuel sources ahead of approaching fire, literally creating a containment line by starving the fire of its fuel source much like air tankers dropping suppressant ahead of a wildfire to stop it from spreading. This new system and method can be added as an additional tool to the fire service to contain and control the spread of wild fire by boxing it into a containment zone. Surrounding the fire using the method described, fire fighters can now obtain 100% containment faster on big fires. Utility vehicle FIG. 2 can be used in a variety of topographical environments including flat terrain paved and non-paved areas. The Rain maker system sensors and monitors will communicate real time data to incident command as well as provide GPS tracking data of assets deployed, temperatures and ambient conditions in the fire zone.

I claim:

1. A fire containment system comprising:

a cylindrical conduit having first and second ends and a longitudinal axis, with the conduit being made at least in part from aluminum and having a hollow interior and open ends in fluidic communication with the hollow interior of the conduit, the conduit including fittings or nipples, with the open ends being provided with threads;

a quick-connect coupling threadedly connected to one open end of the conduit, with the coupling configured to selectively couple to an appropriate source of fire suppressant or to another conduit via a hose, and the other end of the conduit including one of a cap or a coupling threadedly connected to that open end of the conduit, with the coupling configured to selectively couple to an appropriate source of fire suppressant or to another conduit via a hose;

a plurality of fire nozzles arranged and connected directly onto the fittings or nipples of the conduit and in fluidic communication with the hollow interior of the conduit, wherein at least two nozzles are mounted on the fittings or nipples of the conduit at arched angles with respect to the conduit to spray and direct fire suppressant at the arched angles upwardly and away from the conduit to provide a coverage area that is at least 120 feet wide and that extends to a height of up to five stories of reach from the conduit, with each nozzle being capable of delivering at least 300 gallons per minute when operatively associated with an appropriate source of fire suppressant and high pressure pumping equipment; and a horizontal anchor plate located beneath and operatively connected with the conduit for preventing rotation of the conduit when spraying fire suppressant from the nozzles, wherein the first end of the horizontal anchoring plate extends away from the longitudinal axis of the conduit in one direction and the second end of the conduit extends away from the longitudinal axis of the conduit in another direction.

2. The system of claim 1, wherein the first end of the horizontal anchoring plate extends away from the longitudinal axis of the conduit in one direction and the second end of the conduit extends away from the longitudinal axis of the conduit in the opposite direction.

3. The system of claim 1, wherein the conduit includes a base plate secured thereto and the horizontal anchoring plate is secured to the base plate at an angle thereto.

4. The system of claim 3, wherein the horizontal elongated anchoring plate is oriented essentially perpendicularly to the conduit, with the anchoring plate optionally include apertures for receiving metal stakes to anchor the plate to the ground.

5. The system of claim 1, wherein the at least two nozzles are mounted on the fittings or nipples of the conduit at arched angles of 40 to 45 degrees with respect to the conduit.

6. The system of claim 1, including at least two additional nozzles arranged upon the conduit, with at least one additional nozzle arranged near each end of the conduit, with each nozzle being a commercial grade fire nozzle capable of delivering at least 300 gallons per minute when operatively associated with an appropriate source of fire suppressant and high pressure pumping equipment.

7. The system of claim 1, wherein the conduit has an inside diameter of 4 to 6 includes and a length of 40 to 48 inches, and the fire nozzles provide a predetermined spray pattern of fire suppressant when associated with high pressure pumping equipment and liquid fire suppressant, such that the suppressant can be dispersed into the atmosphere to create a rain-like effect in a contiguous 360 degree pattern.

8. The system of claim 1, further comprising a carrying handle secured to the conduit for transport thereof and a strobe light, reflective tape or glow in the dark paint associated with conduit for visual identification.

9. The system of claim 1, further comprising a bracket containing box that includes a digital instrumentation cluster, GPS, and sensor associated on the conduit for wirelessly transmitting information from the conduit to assist in locating position.

10. The system of claim 1, wherein the plurality of nozzles include two nozzles present on a longitudinal cross-section of the conduit and two nozzles near each end of the conduit.

11. The system of claim 1, wherein multiple conduits as claimed are combined to achieve the desired goal of protection and containment, with each conduit having forward and rear ends in fluidic communication with the hollow interior of the conduit, and a quick-connect coupling attached to each of the forward and rear ends of the conduit with each coupling configured to selectively couple to a cap, to an appropriate source of fire suppressant, or to another conduit via a hose.

12. The system of claim 11, wherein 400 or more of the conduits are connected by fire hoses to traverse thousands of linear feet over any type terrain.

13. A method for containing a fire which comprises arranging the fire containment system according to claim 1 that includes plurality of conduits and respective fire nozzles adjacent to a fire or in the path of a wildfire; providing fire suppressant to the conduit(s) and spraying and directing the fire suppressant upon or in front of the fire to prevent the fire from spreading.

14. The method of claim 13, wherein the fire suppressant is a suppressant slurry, gel mix or water, and is sprayed at a rate of at least 600 gallons per minute per conduit to starve the fire of fuel sources.

15. A fire containment system comprising:

a cylindrical conduit having first and second ends and a longitudinal axis, with the conduit being made at least in part from aluminum and having a hollow interior and open ends in fluidic communication with the hollow interior of the conduit, the conduit including fittings or nipples, with the open ends being provided with threads;

a quick-connect coupling threadedly connected to one open end of the conduit, with the coupling configured to selectively couple to an appropriate source of fire suppressant or to another conduit via a hose, and the other end of the conduit including one of a cap or a coupling threadedly connected to that open end of the conduit, with the coupling configured to selectively couple to an appropriate source of fire suppressant or to another conduit via a hose;

a plurality of fire nozzles arranged and connected directly onto the fittings or nipples of the conduit and in fluidic communication with the hollow interior of the conduit, wherein at least two nozzles are mounted on the fittings or nipples of the conduit at arched angles of 40 to 45 degrees with respect to the conduit to spray and direct fire suppressant at the arched angles upwardly and away from the conduit to provide a coverage area that is at least 120 feet wide and that extends to a height of up to five stories of reach from the conduit, and including at least one additional nozzle arranged near each end of the conduit, with each nozzle being capable of delivering at least 300 gallons per minute when operatively associated with an appropriate source of fire suppressant and high pressure pumping equipment; and a horizontal anchor plate located beneath and operatively connected with the conduit for preventing rotation of the conduit when spraying fire suppressant from the nozzles, wherein the first end of the horizontal anchoring plate extends away from the longitudinal axis of the conduit in one direction and the second end of the conduit extends away from the longitudinal axis of the conduit in another direction.

16. A method for containing a fire which comprises arranging the fire containment system according to claim 15 that include one or a plurality of conduits and respective fire nozzles adjacent to a fire or in the path of a wildfire; providing fire suppressant to the conduit(s) and spraying and directing the fire suppressant upon or in front of the fire to prevent the fire from spreading.

17. The method of claim 16, wherein the fire suppressant is a suppressant slurry, gel mix or water, and is sprayed at a rate of at least 1200 gallons per minute per conduit to starve the fire of fuel sources.

* * * * *

UNITED STATES PATENT AND TRADEMARK OFFICE

CERTIFICATE OF CORRECTION

PATENT NO. : 8,794,341 B2
APPLICATION NO. : 13/068268
DATED : August 5, 2014
INVENTOR(S) : John Wayne Howard, Sr.

It is certified that error appears in the above-identified patent and that said Letters Patent is hereby corrected as shown below:

In the Drawings:

Replace Fig. 3 with the following:

FIG. 3

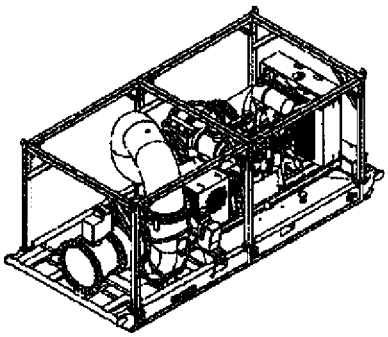

78,000 GPM Mobile liquid fire suppressant pump

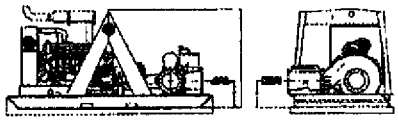

16,000 GPM Mobile liquid fire suppressant pump

Signed and Sealed this
Twenty-first Day of October, 2014

Michelle K. Lee

Michelle K. Lee
*Deputy Director of the United States Patent and Trademark Office*

Drawings (continued):
Replace Fig. 4 with the following:

6,900 Gallon tank 21,000 Gallon mobile liquid fire suppressant storage tank

Replace Fig. 7 with the following:

Automatic Fire nozzle

In the Claims:
Column 17:
Line 44 (claim 13, line 3), before “plurality”, insert -- a --.